US010892113B2

(12) United States Patent
Abdala

(10) Patent No.: US 10,892,113 B2
(45) Date of Patent: Jan. 12, 2021

(54) ROTATING HANDLE DEVICE

(71) Applicant: WEG Drives and Controls Automação LTDA, Jaragua do Sul (BR)

(72) Inventor: João Paulo Abdala, Jaragua do Sul (BR)

(73) Assignee: WEG DRIVES AND CONTROLS AUTOMAÇÃO LTDA, Jaraguá Do Sul (BR)

( * ) Notice: Subject to any disclaimer, the term of this patent is extended or adjusted under 35 U.S.C. 154(b) by 110 days.

(21) Appl. No.: 16/103,819

(22) Filed: Aug. 14, 2018

(65) Prior Publication Data

US 2019/0057820 A1 Feb. 21, 2019

(30) Foreign Application Priority Data

Aug. 15, 2017 (BR) ..... 102017017485

(51) Int. Cl.

| | |
|---|---|
| ***G05G 1/10*** | (2006.01) |
| ***G05G 5/00*** | (2006.01) |
| ***G05G 5/06*** | (2006.01) |
| ***H01H 3/10*** | (2006.01) |
| ***H01H 9/28*** | (2006.01) |

(Continued)

(52) U.S. Cl.

CPC ..... *H01H 3/10* (2013.01); *G05G 1/10* (2013.01); *G05G 5/06* (2013.01); *H01H 9/22* (2013.01); *H01H 9/282* (2013.01); *G05G 5/005* (2013.01); *G05G 2505/00* (2013.01); *H01H 2019/008* (2013.01); *H01H 2233/056* (2013.01)

(58) Field of Classification Search

CPC .. H01H 3/10; G05G 5/06; G05G 1/10; G05G 2505/00; G05G 5/005

See application file for complete search history.

(56) References Cited

U.S. PATENT DOCUMENTS

| | | | | |
|---|---|---|---|---|
| 4,851,621 | A | 7/1989 | Borchardt et al. | |
| 6,380,733 | B1 * | 4/2002 | Apel | B60K 37/06 324/207.2 |

(Continued)

FOREIGN PATENT DOCUMENTS

| | | | |
|---|---|---|---|
| BR | PI0900074 | A2 | 10/2010 |
| DE | 9320753 | U1 | 4/1995 |

(Continued)

OTHER PUBLICATIONS

English Abstract of DE 102013216088 A1, Brecko et al., Feb. 19, 2015 (Year: 2015).*

*Primary Examiner* — Vinh Luong

(74) *Attorney, Agent, or Firm* — Troutman Pepper Hamilton Sanders LLP; Ryan A. Schneider

(57) ABSTRACT

A rotating handle device formed by the the mounting of an assembly including an attachment base that receives a grip and a sliding button, a sliding limiting drive member, and a fixing cover. The fastening between the sliding button, grip, attachment base, and fixing cover is achieved by pressure fastening engagements snap-fits. The assembly includes a mounting method that prevents removal of the grip from the attachment base unless the sliding button is removed first, and a mounting or dismounting process between the grip and the attachment base that may only take place upon the coincidence between pairs of flaps and passing recessions.

22 Claims, 14 Drawing Sheets

(51) Int. Cl.
*H01H 9/22* (2006.01)
*H01H 19/00* (2006.01)

(56) References Cited

U.S. PATENT DOCUMENTS

| | | | | |
|---|---|---|---|---|
| 7,171,728 | B2 * | 2/2007 | Chirumbolo | H01H 3/08 16/429 |
| 7,214,895 | B2 * | 5/2007 | Houck, III | H01H 71/04 200/310 |
| 2017/0235328 | A1 * | 8/2017 | Swayne | G05G 1/10 74/532 |
| 2018/0267568 | A1 * | 9/2018 | Faurie | G05G 5/05 |
| 2018/0308649 | A1 * | 10/2018 | Kubes | H01H 36/02 |
| 2019/0198276 | A1 * | 6/2019 | Abdala | H01H 69/00 |
| 2020/0191259 | A1 * | 6/2020 | Bagley | F16H 59/02 |

FOREIGN PATENT DOCUMENTS

| | | | |
|---|---|---|---|
| DE | 102013216088 | A1 * | 2/2015 |
| EP | 0564173 | B1 | 10/1993 |
| EP | 0774766 | A1 | 5/1997 |
| EP | 2306480 | A2 | 4/2011 |
| FR | 2867895 | A1 | 9/2005 |
| GB | 2180098 | B | 3/1987 |

* cited by examiner

Section View X-X

Section View XII-XII

Section View XIV-XIV

ROTATING HANDLE DEVICE

CROSS-REFERENCE TO RELATED APPLICATIONS

This application claims the benefit of BR Patent Application Serial No. 10 2017 017485-9 filed on 15 Aug. 2017, the benefit of the earlier filing date of which is hereby claimed under 35 USC § 119(a)-(d) and (f). The entire contents and substance of the application is hereby incorporated by reference.

BACKGROUND OF THE INVENTION

1. Field of the Invention

The present invention relates generally to rotary handle devices, and more particularly to rotating handle devices useful in operating a molded case circuit breaker, a motor circuit breaker, and a switch-disconnector, among others, mounted on the door of an electric protection cabinet.

2. Description of Related Art

Several types of mechanisms and handles with different shapes and mounting techniques for operation of electric equipment through electric switches are known in the conventional state of the art, more specifically rotary handle devices including functions "ON", "OFF", "LOCK", "TRIP" and "RESET" as their main functions.

The competitiveness of the current global market urges industries to manufacture end products with the lowest possible cost. Screws are safe and reliable elements for mechanical fastening. However, screw-based fastening is expensive since it requires additional devices and is time consuming, and further needs a specific area of mounting when compared to, for example, pressure fastening engagements (snap-fits). Therefore, products that do not include screws tend to be less expensive and easier to manufacture, which are intrinsic factors to the competitiveness in the industry.

Rotary handles for operation of a circuit breaker are known. A constructive example is disclosed in BRPI0900074-7, according to which the rotary handle for operating a circuit breaker comprises a housing for a rod to be used in a panel door where, through the rod, the handle installed on the door mechanically communicates with the circuit breaker inside the panel. The handle includes a button having a rotation locking pin on a rod locking trigger pin, for use with a pad-lock or similar device.

GB2180098B discloses a method of providing fastening through a pressure pin from an intermediate rotating member to an intermediate bracket.

DE9320753U1, on the other hand, discloses a handle including quick fastening devices, but without a blocking or position locking feature for the handle.

Conventional pad-locking rotating handles or similar devices, for fastening on doors or cases, include among other features elements fastened by pins or clamps (DE3901260A1), or screws (EP0774766A1 and EP2306480B1).

Several exemplary means are available, developed for fastening the mounting itself, however, the constant search for improvement has encouraged evolution for some unsolved issues in the state of the art.

BRIEF SUMMARY OF THE INVENTION

Briefly described, in a preferred form, the present invention comprises a rotary handle device comprising the mounting of an assembly, comprising externally (to a user), a grip that receives a sliding button, the grip rotates while connected to an attachment base, and comprising, internally (to a user), a sliding limiting drive member and an fixing cover mounted to the attachment base, among other components, wherein the assembly comprises, in its external and internal facing components, for fastening between sliding button, grip, attachment base and fixing cover, only pressure fastening engagements for closing the assembly.

A mounting or dismounting between grip and attachment base may only takes place when the flap and the recession are coincided.

The grip can comprise a guide groove for movement of the sliding button, through the pressure fastening engagement.

The grip can comprise a groove and flaps with different dimensions between each other.

The grip can comprise a cruciform-shaped coupling cavity.

The attachment base can comprise a passing hole and recessions with different dimensions between each other.

The sliding limiting drive member can allow coupling of the pin of the sliding button on the "OFF" operating position at the passing hole and allow locking in the "ON" position of the pin of the sliding button at the optional blocking hole.

The assembly of the rotary handle device can be added by the complementary steering guide of the cruciform-shaped latch.

Briefly described, in another preferred form, the present invention comprises a mounting method for rotary handle device comprising introduction of the grip in the base externally (to a user), from a cylindrical ring of the grip and the flap, at the recession of the base until the support base touches the ring, twisting the previously introduced grip until the "OFF" position, where the hole coincides with the seat, when mounted between each other, introduction of the sliding button in the cavity of the grip, until the pressure fastening engagement reaches the guide groove of the grip, and one of the objectives of the invention is to provide a rotary handle for operate a circuit breaker, whose attachment of elements does not use screws.

Another objective of the invention is to provide a simplified assembly rotary handle that is able to block activation of a circuit breaker.

It is also an objective of the invention to provide a rotary handle for operate a circuit breaker with reduced number of components, compared to other assemblies of the state of the art.

Another objective of the invention is to provide a rotary handle that enables configuration for transferring the rotating grip movement to a motion transferring mechanism, mounted on a molded case circuit breaker, in order to drive the linear handle of the circuit breaker, or mounted onto a motor circuit breaker, directly to its drive shaft, by its own mechanism and a drive rod, which is coupled with the rotating handle at the protection panel door.

Another objective of the invention is to provide a safety block mean for the door of a protection panel, preventing the door from being opened when a circuit breaker device is in the "ON" position.

Another objective of the invention is to enable, through a lock or padlock mean, can be possible blocking of the handle in its "OFF" position, for example.

Briefly described, in another preferred form, the present invention comprises a rotary handle device comprising a grip having a first end and a second end, a sliding button having a first end and a second end, wherein the second end of the sliding button is received within the first end of the grip, an attachment base having a first end and a second end, wherein the second end of the grip is rotatably connected in proximity to the first end of the attachment base, and wherein the grip is rotatable while rotatably connected to the attachment base, a sliding limiting drive member located within the attachment base, a fixing cover mounted in proximity to the second end of the attachment base, and pressure fastening engagements snap-fits, wherein the grip is releasably mountable to the attachment base, and wherein the grip, sliding button, attachment base and fixing member are engagingly communicative to one another to form the rotary handle device via the pressure fastening engagements snap-fits.

The grip, sliding button, attachment base and fixing member can be engagingly communicative to one another to form the rotary handle device only via the pressure fastening engagements snap-fits.

The grip can comprise a guide assembly groove, wherein the sliding button comprises one of the pressure fastening engagements snap-fits, and wherein the guide assembly groove is for movement guiding of the pressure fastening engagements snap-fit of the sliding button.

The grip can comprise a first flap radially spaced apart from a second flap, each in proximity to the second end of the grip, wherein the attachment base comprises a first passing recession radially spaced apart from a second passing recession, each in proximity to the second end of the attachment base, wherein the first flap and the first passing recession are sized such that the first flap can move through the first passing recession when cooperative aligned, wherein the second flap and the second passing recession are sized such that the second flap can move through the second passing recession when cooperative aligned, and wherein only during cooperative alignment of the respective flaps of the grip to the corresponding respective passing recessions of the attachment base can the grip be mounted to, and released from, the attachment base.

The first flap and second flap can different in respect to at least one of size and shape such that at least one of: the first flap can move through the first passing recession when cooperative aligned with the first passing recession, and cannot move through the second passing recession when otherwise cooperative aligned with the second passing recession, and the second flap can move through the second passing recession when cooperative aligned with the second passing recession, and cannot move through the first passing recession when otherwise cooperative aligned with the first passing recession.

The first flap and second flap can be of such similarity in respect to size and shape that first flap can move through either the first or second passing recession when cooperative aligned with one of them, and the second flap can move through the other of the first or second passing recession when cooperative aligned with the other one of them.

The rotary handle device can have at least two operating positions "OFF" and "ON" reached via rotational movement of the grip, wherein the sliding button comprises a trigger pin, wherein the sliding limiting drive member a passing hole and a blocking hole, wherein in the "OFF" operating position, the sliding limiting drive member allows coupling of the trigger pin of the sliding button at the passing hole, and wherein in the "ON" operating position, the sliding limiting drive member allows locking of the trigger pin of the sliding button at the blocking hole.

The rotary handle device can further comprise a complementary steering guide, and a cruciform-shaped latch.

The grip can further comprise a cruciform-shaped coupling cavity, a cylindrical ring, and first and second passing holes, wherein the first and second flaps protrude from the cylindrical ring, and wherein the angle between the first flap and the first passing hole is 90°.

The attachment base can have a horizontal axis of symmetry and a vertical axis of symmetry and comprise a central orifice, first and second radially spaced apart rotary limiting members, a first positioning seat, a ribbed positioning seat, and a support ring, wherein the positioning seat is aligned to the horizontal axis of symmetry, wherein the angle between the first rotary limiting member and the first passing recession is less than 90°, and wherein the angle between the second rotary limiting member and the second passing recession is less than 90°.

Briefly described, in another preferred form, the present invention comprises a rotary handle device comprising a grip having a first end, a second end, a guide assembly groove, and a first flap radially spaced apart from a second flap each in proximity to the second end of the grip, a sliding button having a first end and a second end, wherein the second end of the sliding button is received within the first end of the grip, an attachment base having a first end, a second end, and a first passing recession radially spaced apart from a second passing recession each in proximity to the second end of the attachment base, wherein the second end of the grip is rotatably connected in proximity to the first end of the attachment base, and wherein the grip is rotatable while rotatably connected to the attachment base, a sliding limiting drive member located within the attachment base, a fixing cover mounted in proximity to the second end of the attachment base, and pressure fastening engagements snap-fits, wherein the grip is releasably mountable to the attachment base, wherein the grip, sliding button, attachment base and fixing member are engagingly communicative to one another to form the rotary handle device via only the pressure fastening engagements snap-fits, wherein the sliding button comprises one of the pressure fastening engagements snap-fits, wherein the guide assembly groove is for movement guiding of the pressure fastening engagements snap-fit of the sliding button, wherein the first flap and the first passing recession are sized such that the first flap can move through the first passing recession when cooperative aligned, wherein the second flap and the second passing recession are sized such that the second flap can move through the second passing recession when cooperative aligned, and wherein only during cooperative alignment of the respective flaps of the grip to the corresponding respective passing recessions of the attachment base can the grip be mounted to, and released from, the attachment base.

The rotary handle device can have at least two operating positions "OFF" and "ON" reached via rotational movement of the grip, wherein the sliding button comprises a trigger pin, wherein the sliding limiting drive member a passing hole and a blocking hole, wherein in the "OFF" operating position, the sliding limiting drive member allows coupling of the trigger pin of the sliding button at the passing hole, and wherein in the "ON" operating position, the sliding limiting drive member allows locking of the trigger pin of the sliding button at the blocking hole.

The rotary handle device can further comprise a complementary steering guide, and a cruciform-shaped latch.

The first flap and second flap can be different in respect to at least one of size and shape such that at least one of: the first flap can move through the first passing recession when cooperative aligned with the first passing recession, and cannot move through the second passing recession when otherwise cooperative aligned with the second passing recession, and the second flap can move through the second passing recession when cooperative aligned with the second passing recession, and cannot move through the first passing recession when otherwise cooperative aligned with the first passing recession.

The first flap and second flap can be of such similarity in respect to size and shape that first flap can move through either the first or second passing recession when cooperative aligned with one of them, and the second flap can move through the other of the first or second passing recession when cooperative aligned with the other one of them.

The grip can further comprise a cruciform-shaped coupling cavity, a cylindrical ring, and first and second passing holes, wherein the first and second flaps protrude from the cylindrical ring, and wherein the angle between the first flap and the first passing hole is 90°.

The attachment base can have a horizontal axis of symmetry and a vertical axis of symmetry and further comprise a central orifice, first and second radially spaced apart rotary limiting members, a first positioning seat, a ribbed positioning seat, and a support ring, wherein the positioning seat is aligned to the horizontal axis of symmetry, wherein the angle between the first rotary limiting member and the first passing recession is less than 90°, and wherein the angle between the second rotary limiting member and the second passing recession is less than 90°.

Briefly described, in another preferred form, the present invention comprises a method of forming one or more of the above rotary handle devices comprising introducing the grip into the attachment base from the cylindrical ring of the grip and the first and second flaps, at the first and second recessions of the attachment base until a support base of the grip touches the support ring, twisting the introduced grip until the "OFF" operating position, wherein one of the first and second passing holes coincide with the positioning seat when mounted between one another, and introducing the sliding button into the cruciform-shaped coupling cavity of the grip until the pressure fastening engagements snap-fit of the sliding button reaches the guide assembly groove of the grip.

These and other objects, features and advantages of the present invention will become more apparent upon reading the following specification in conjunction with the accompanying drawing figures.

DETAIL DESCRIPTION OF THE INVENTION

Figure 1:
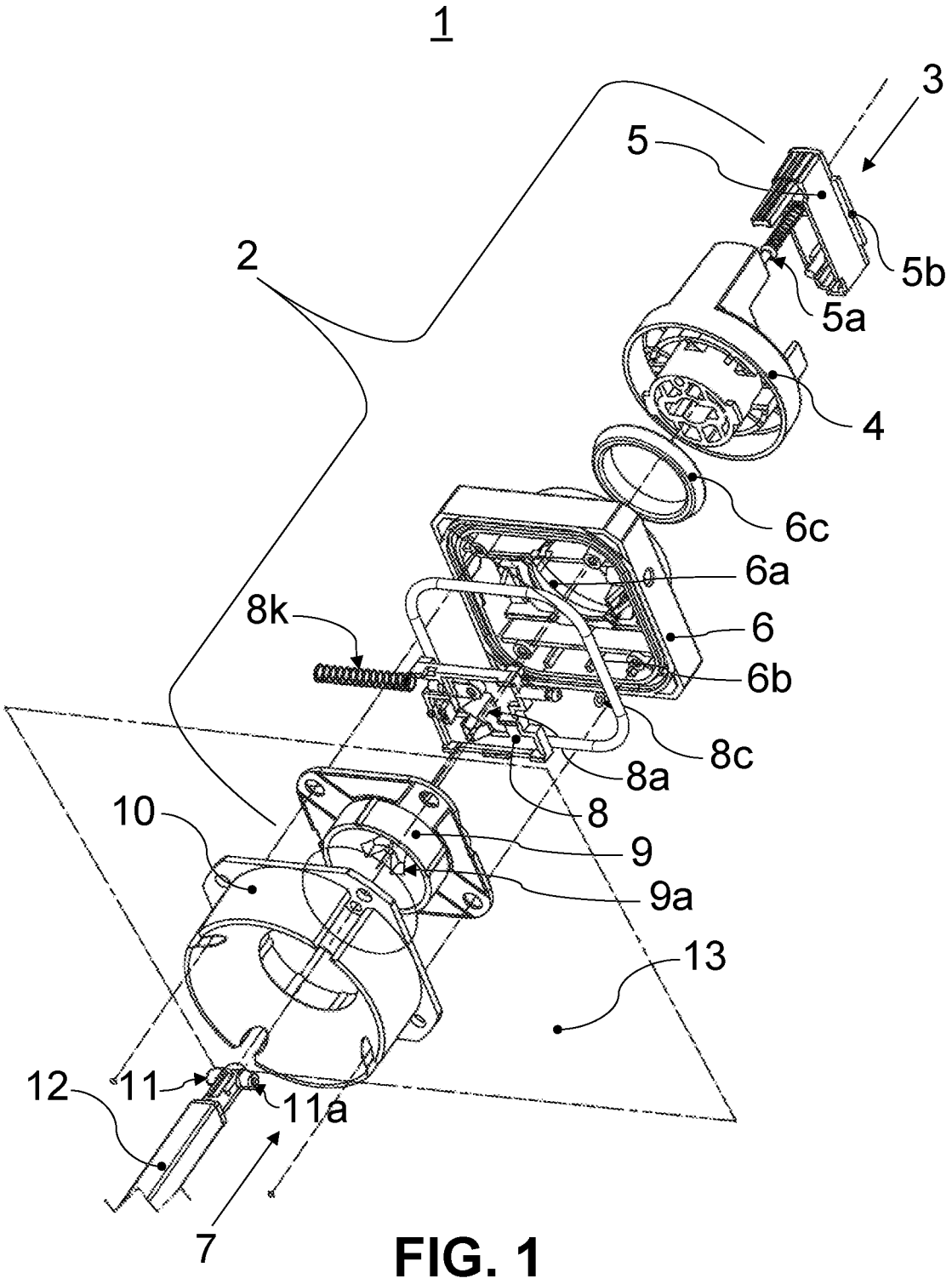
FIG. 1 shows an exploded perspective view of a rotary handle device assembly, according to an exemplary embodiment of the present invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

As used herein, the present invention has internal components (not viewable to a user of the invention unless the invention is dissembled), and components that include at least a portion that are viewable by the user of the assembled invention. Sometimes herein components will be described as being internal, or at an internal side, or being of an internal portion of the invention, or other like descriptions to mean those above-defined internal components. Sometimes herein components will be described as being external, or at an external side, or being of an external portion of the invention, or other like descriptions to mean those above-defined external components.

As used herein, components of the present invention may have a first end and a second end. The first end is intended to mean the end of the component distal the mounting (or toward ultimately the sliding button), and the second end is intended to mean the end of the component proximal the mounting (or toward ultimately the fixing cover).

the present invention has internal components (not viewable to a user of the invention unless the invention is dissembled), and components that include at least a portion that are viewable by the user of the assembled invention. Sometimes herein components will be described as being internal, or at an internal side, or being of an internal portion of the invention, or other like descriptions to mean those above-defined internal components. Sometimes herein components will be described as being external, or at an external side, or being of an external portion of the invention, or other like descriptions to mean those above-defined external components.

FIG. 1 shows an exploded perspective view of a rotary handle device 1 comprising the mounting of an assembly 2 mounted to a hinged door 13 of a cabinet (not shown), for example, according to an exemplary embodiment of the present invention.

The assembly 2 comprises a grip 4, a sliding button 5, an attachment base 6, a sliding limiting drive member 8, and a fixing cover 9. Externally, the grip 4 receives the sliding button 5. Sliding button 5 comprises an engagement flap 5*b* being assembled while fitted onto the attachment base 6, having a central orifice 6*a*, comprising internally (shown as an internal portion 7) the sliding limiting drive member 8 comprising a central hole 8*a*, and the fixing cover 9 mounted to the attachment base 6. The fixing cover 9 includes a cruciform-shaped central hole 9*a*.

The assembly 2 can further comprise a complementary steering guide 10, a cruciform-shaped latch 11, and extender rod 12. The cruciform-shaped latch 11 comprises a tooth 11*a*, the extender rod 12, and a return spring 8*k*. The assembly 2 of the rotary handle device 1 may be sealed against weathering, such as water, dust, and similar conditions, through sealants, seal ring 6*b* and elements 5*a*, 6*c*, 8*c* as disclosed hereinafter.

Figure 2:
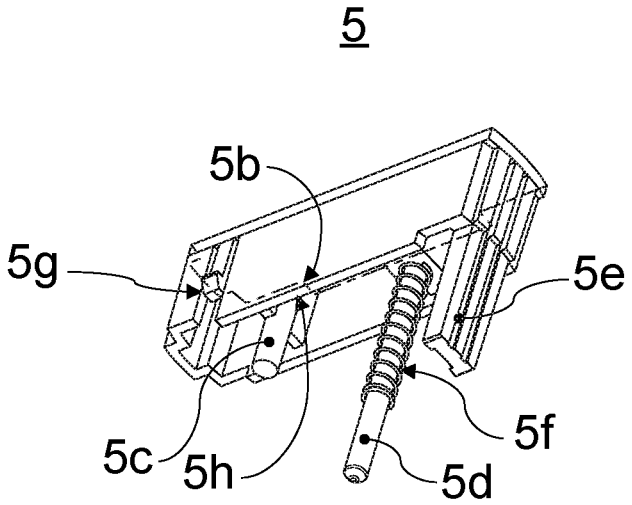
FIG. 2 shows a perspective view of a button, according to an exemplary embodiment of the present invention.

FIG. 2 shows a perspective view of the sliding button 5 comprising the engagement flap 5*b*, a settling pin 5*c*, a trigger pin 5*d*, a position locking rod 5*e*, a motion return spring 5*f*, a pressure fastening engagements snap-fit 5*g*, and a limiting bottom 5*h*. The trigger pin 5*d* of the position locking rod 5*e* blocks the motion return spring 5*f* wrapped around the trigger pin 5*d*.

Figure 3A:
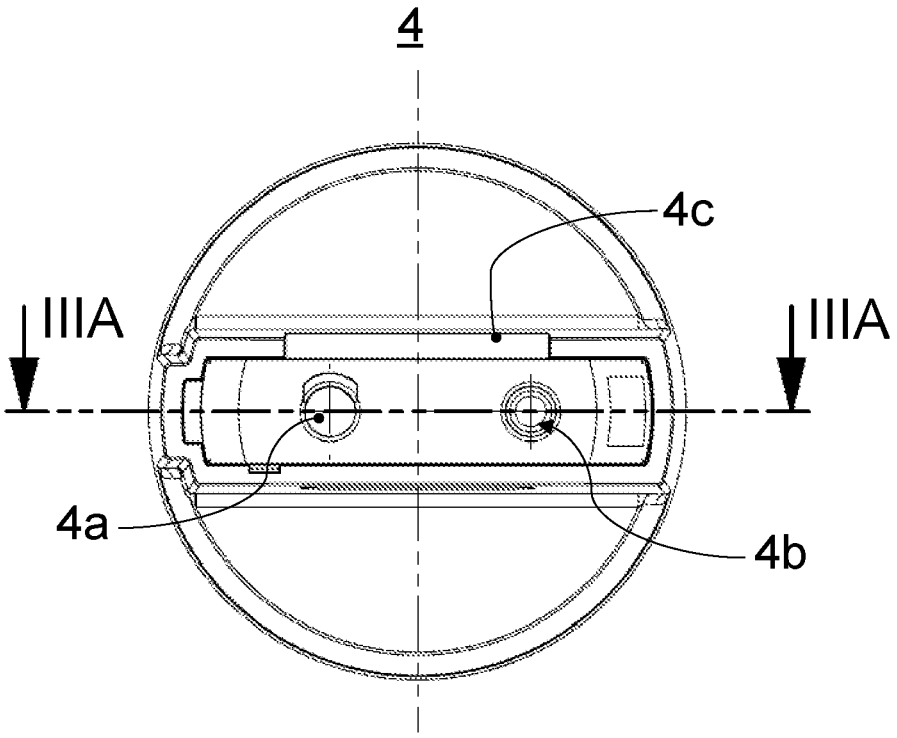
FIG. 3A shows an upper front view of a grip, according to an exemplary embodiment of the present invention.

FIG. 3A shows an upper front view of the grip 4 illustrating a blind hole 4*a*, a rotation blocking passing hole 4*b*, and a recess 4*c*. The blind hole 4*a* is related to the settling pin 5*c*, the rotation blocking passing hole 4*b* is related to the trigger pin 5*d* of the position locking rod 5*e* for blocking, and the recess 4*c* is related to the engagement of the engagement flap 5*b* shown in FIGS. 1 and 2.

Figure 3B:
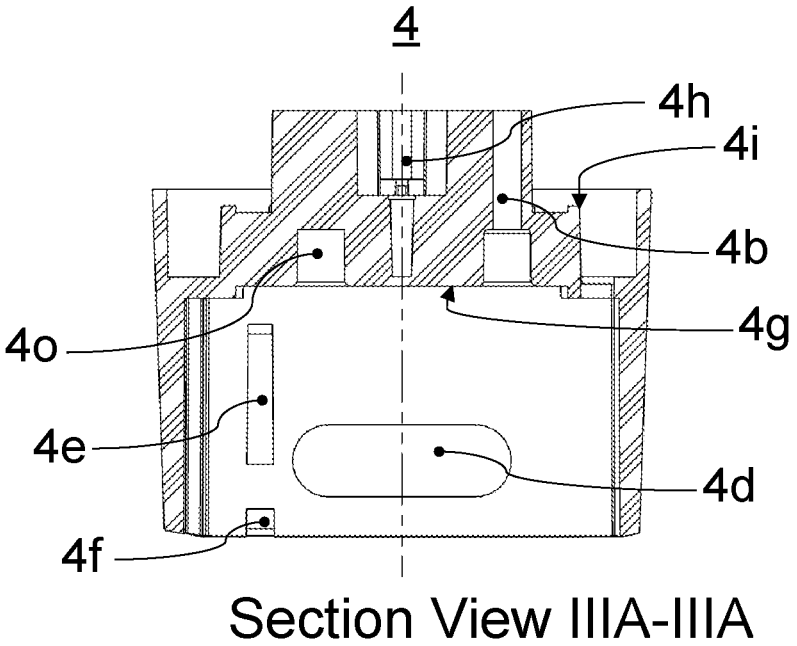
FIG. 3B shows a section view IIIA-IIIA of the grip, according to an exemplary embodiment of the present invention.

FIG. 3B shows a section view IIIA-IIIA of the grip 4 illustrating the rotation blocking passing hole 4*b*, a lock element hole 4*d*, a guide assembly groove 4*e*, an assembly guide groove 4*f*, a cavity 4*g*, a cruciform-shaped coupling cavity 4*h*, a support base 4*i*, and a blind hole 4*o*. The guide assembly groove 4*e* is for movement guiding of the sliding button 5 through the pressure fastening engagements snap-fit 5*g*. The assembly guide groove 4*f* is for the pressure fastening engagements snap-fit 5*g* of the sliding button 5, as shown in FIG. 2.

Figure 4:
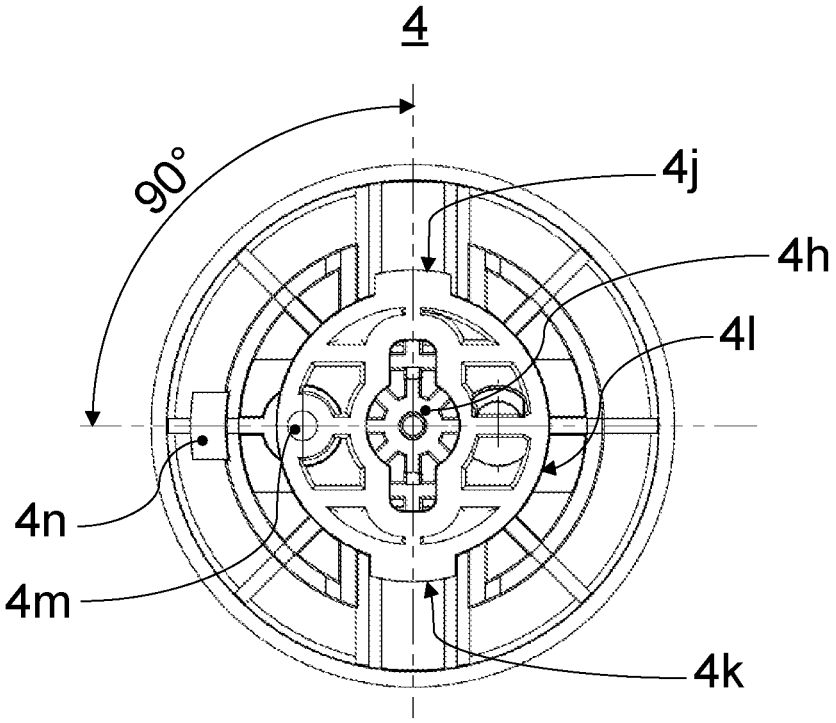
FIG. 4 shows a bottom front view of the grip, according to an exemplary embodiment of the present invention.

FIG. 4 shows a bottom front view of the grip 4 illustrating the cruciform-shaped coupling cavity 4*h*, two radially opposite flaps 4*j*, 4*k* protruding from a cylindrical ring 4*l*, a passing hole 4*m* and a passing hole 4*n*, in which a preferred angle between the flap 4*j* and the passing hole 4*n* is 90°, and which the flaps 4*j* and 4*k* are different from one another.

Figure 5:
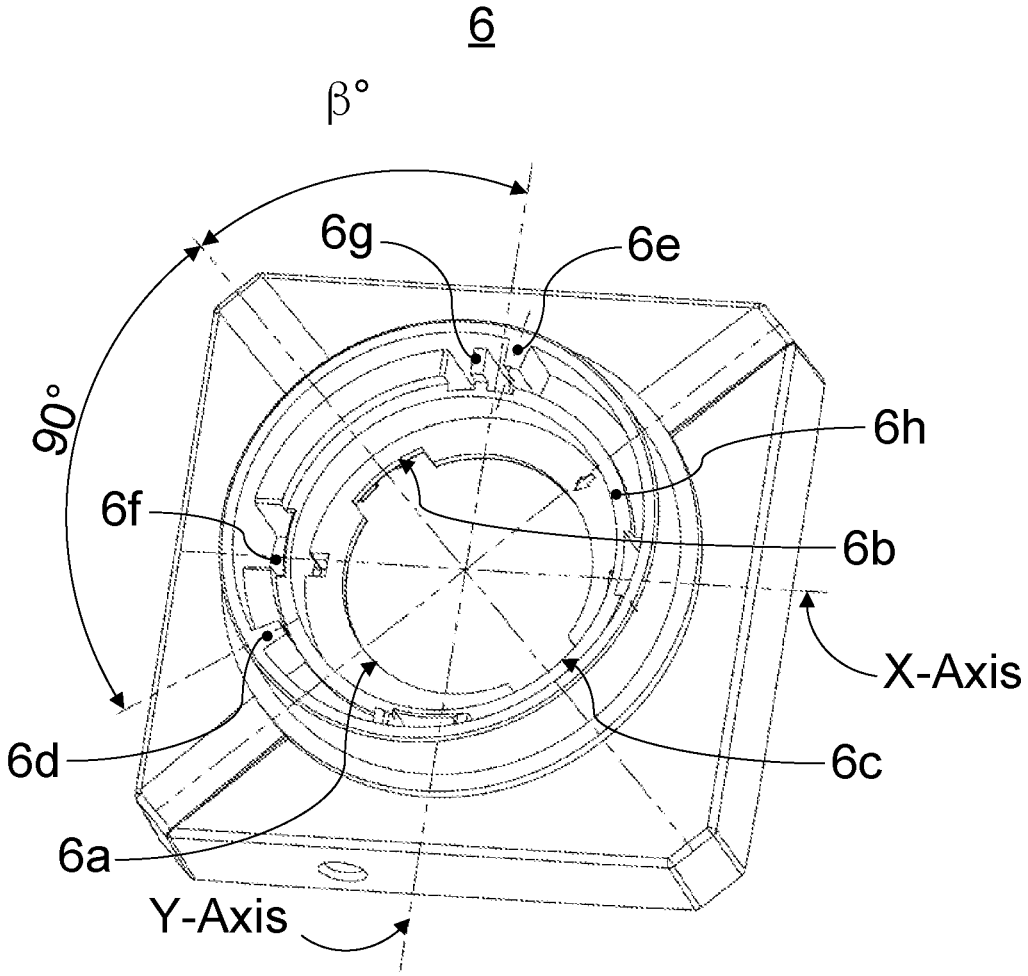
FIG. 5 is an upper perspective view of a base, according to an exemplary embodiment of the present invention.

FIG. 5 is an upper perspective view of the attachment base 6 illustrating a horizontal axis of symmetry "X-Axis", a vertical axis of symmetry "Y-Axis", the central orifice 6*a*, passing recessions 6*b*, 6*c*, rotary limiting members 6*d*, 6*e*, a positioning seat 6*f*, a ribbed positioning seat 6*g*, and a support ring 6*h*. Passing recessions 6*b*, 6 are related to both flaps 4*j*, 4*k*, protruding from the cylindrical ring 4*l* of the grip 4, (as shown in FIG. 4). The positioning seat 6*f* is preferably aligned to the horizontal axis of symmetry "X-Axis", and the ribbed positioning seat 6*g* is related to the position locking rod 5*e* of the sliding button 5 shown in FIG. 2, for blocking the grip 4 as well as the support ring 6*h* for the grip 4, where an exemplary angle $\alpha$ between the rotary limiting member 6*d* and the passing recession 6*b* is less than 90°, and preferred angle β between the rotary limiting member 6*e* and the passing recession 6*c* is less than 90°, and where the passing recession 6*b* has different dimensions from passing recession 6*c*.

Figure 6:
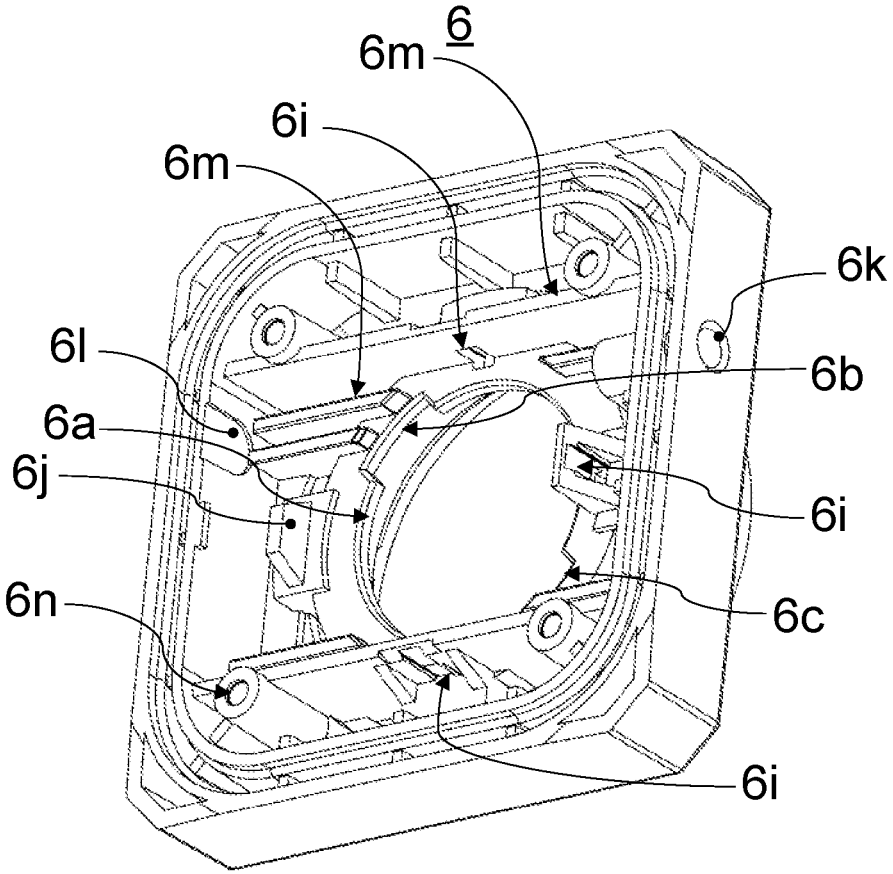
FIG. 6 is a lower perspective view of the base, according to an exemplary embodiment of the present invention.

FIG. 6 shows a bottom perspective view of the attachment base 6 illustrating the central orifice 6*a*, passing recessions 6*b*, 6*c*, locking holes 6*i*, a flow limiting member 6*j*, a bearing hole 6*k*, a spring settling seat 6*l*, sliding rails 6*m*, and fastening holes 6*n* of the attachment base 6 to a door (not shown).

Figure 7A:
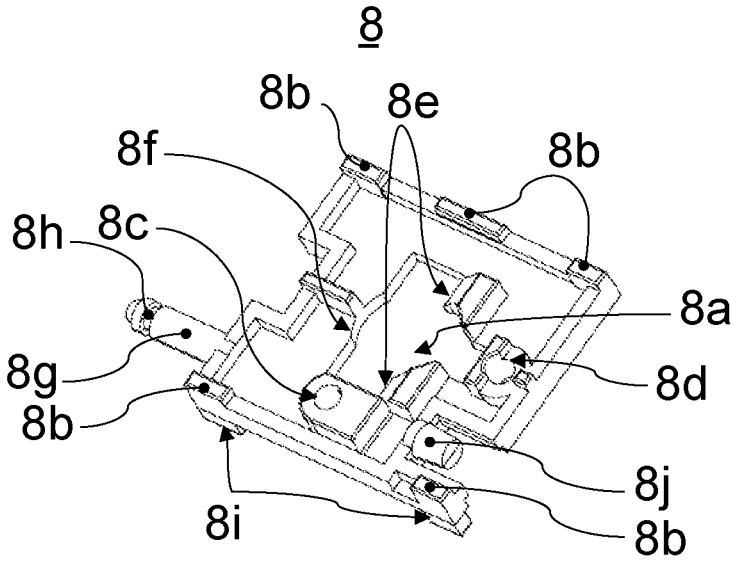
FIG. 7A is a bottom perspective view of a limiting member, according to an exemplary embodiment of the present invention.

FIG. 7A shows a bottom perspective view of the sliding limiting drive member 8 illustrating the central hole 8*a*, sliding surfaces 8*b*, the passing hole 8*c*, an optional blocking hole 8*d*, blocking teeth 8*e*, face 8*f*, a bearing pin 8*g*, a seal notch 8*h*, protruding rails 8*i*, and a seating base 8*j*. The bearing pin 8*g* comprises the seal notch 8*h*, related to the bearing hole 6*k* of the attachment base 6, and the protruding rails 8*i*, related to the sliding rails 6*m* of the attachment base 6, shown in FIG. 6, and the seating base 8*j* for a return spring 8*k*, better shown in FIGS. 1 and 9.

Figure 7B:
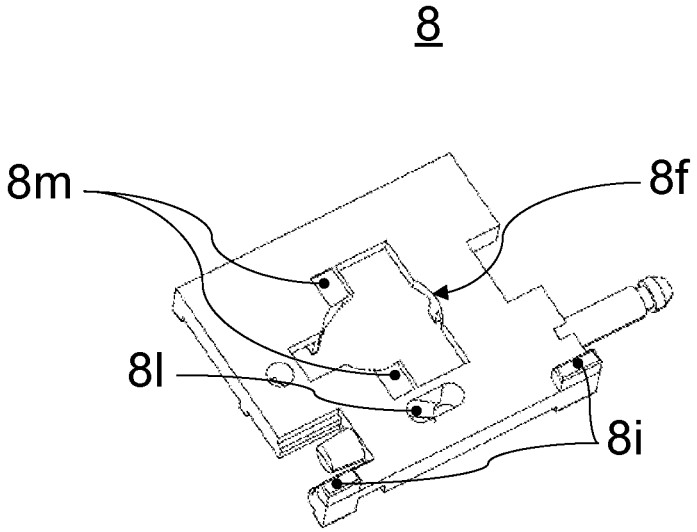
FIG. 7B is an upper perspective view of the limiting member, according to an exemplary embodiment of the present invention.

FIG. 7B shows an upper perspective view of the sliding limiting drive member 8 illustrating the face 8*f*, the protruding rails 8*i*, a translational guide seat 8*l*, and a positioning seat 8*m*.

FIG. 7*b* shows an upper perspective view of the sliding limiting drive member 8 illustrating the face 8*f*, the protruding rails 8*i*, a translational guide seat 8*l*, and a positioning seat 8*m*.

Figure 8:
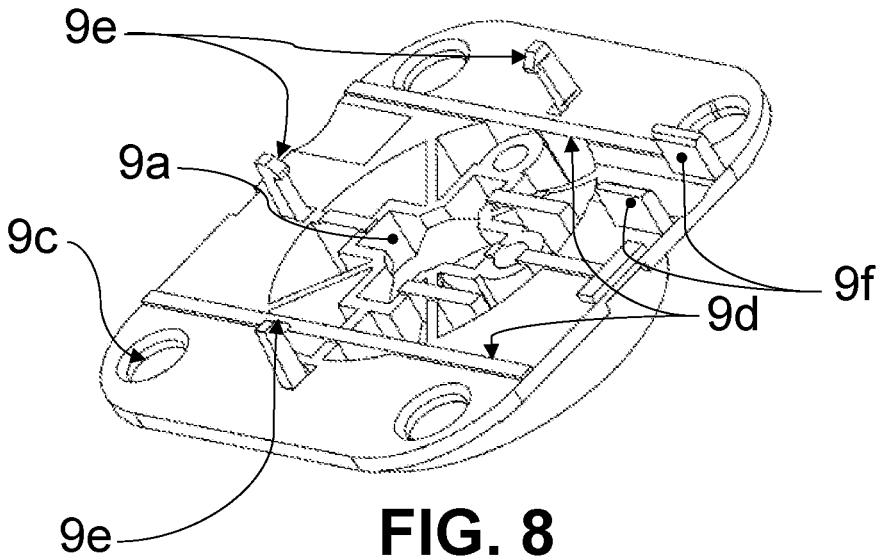
FIG. 8 is a perspective view of a cover, according to an exemplary embodiment of the present invention.
Figure 9:
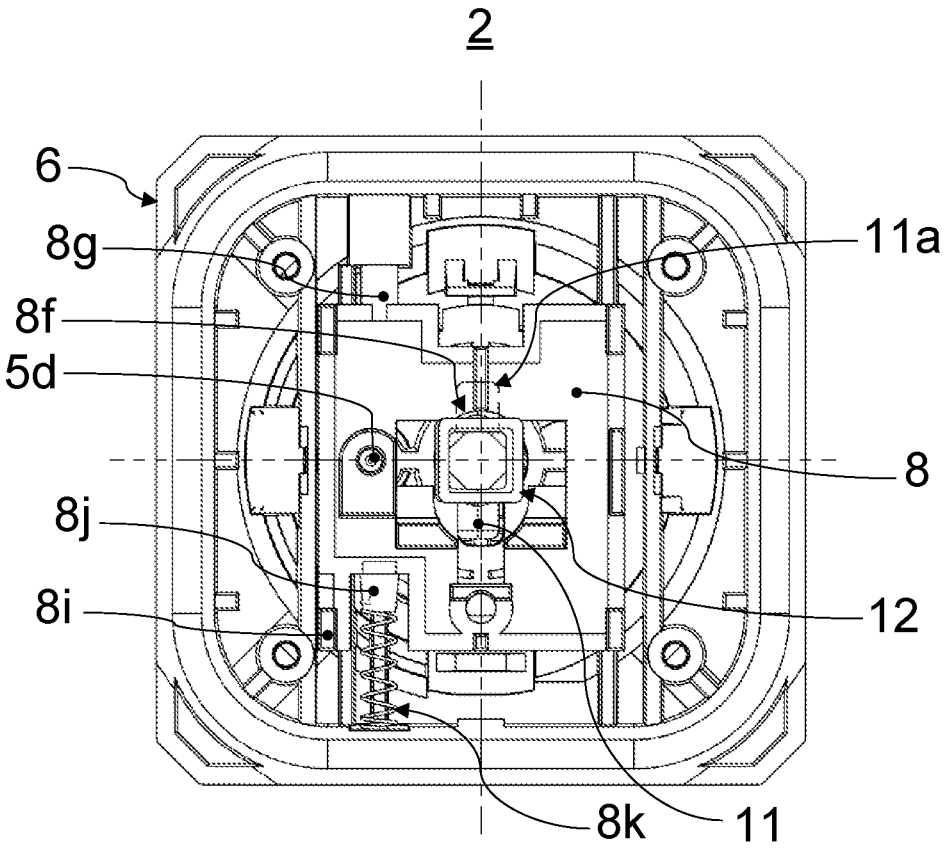
FIG. 9 is a bottom front view of an assembly of the rotary handle device, without the cover and complement guide, in a blocked "OFF" position, according to an exemplary embodiment of the present invention.

FIG. 8 shows a perspective view of the fixing cover 9 illustrating the cruciform-shaped central hole 9*a*, blind holes 9*b*, related to the trigger pin 5*d* of the sliding button 5, passing engagement holes 9*c*, settling rails 9*d*, pressure fastening engagements snap-fit 9*e* for fastening to the locking holes 6*i* of the attachment base 6, shown in FIG. 6, and guide bars 9*f* of the return spring 8*k*, better shown in FIG. 9.

FIG. 9 shows a bottom front view of the assembly mounting 2 seen internally, without the fixing cover 9 and the complementary steering guide 10 of the rotary handle 1. FIG. 9 illustrates the cruciform-shaped latch 11 and the extender rod 12, in an "OFF LOCK" position, (better shown in FIGS. 12 and 13) and the sliding limiting drive member 8 positioned by the trigger pin 5*d* of the position locking rod 5*e* to block the sliding button 5 passing through the blocking hole 8*d* of the sliding limiting drive member 8, shown in FIG. 7A, and locking the cruciform-shaped latch 11 and the extender rod 12 attached to it, partially covering the tooth 11*a* of cruciform-shaped lock 11, as shown in FIG. 1, through the face 8*f* of the sliding limiting drive member 8, shown in FIG. 7A, and where the vertical linear displacement position of the sliding limiting drive member 8 is guided by the protruding rails 8*i*, the bearing pin 8*g* and the return spring 8*k*, mounted to the seating base 8*j* shown in FIG. 7A.

Figure 10:
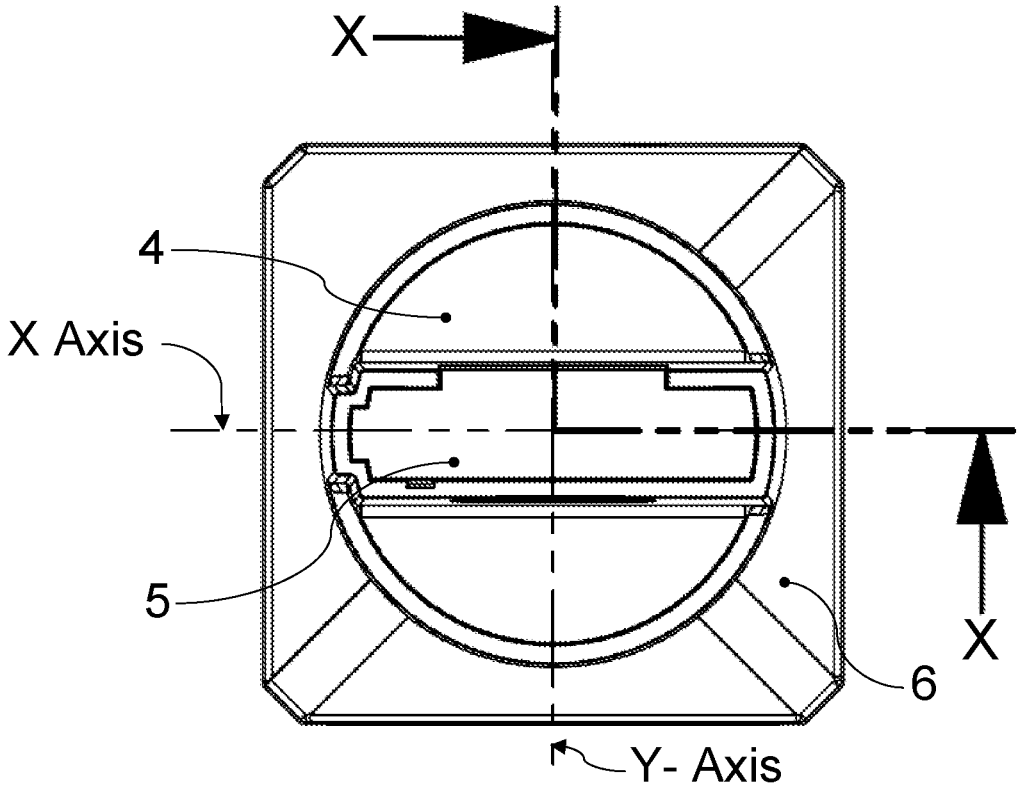
FIG. 10 is an upper front view of the assembly of the rotary handle device, in an "OFF" position, according to an exemplary embodiment of the present invention.

FIG. 10 shows an upper front view of the assembly 2 of the rotary handle device 1, in an "OFF" position, illustrating the sliding button 5, preferably longitudinally aligned to the axis of symmetry "X-Axis", the grip 4 and the attachment base 6.

Figure 11:
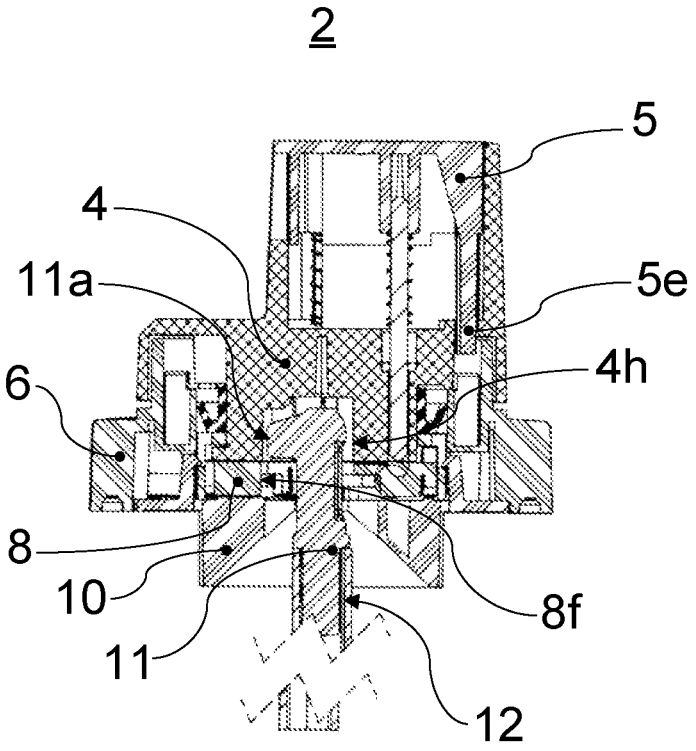
FIG. 11 shows the assembly of the rotary handle device, as well as a cruciform-shaped latch and an extender rod, in a section view X-X, in the "OFF" position, according to an exemplary embodiment of the present invention.

FIG. 11 shows the assembly 2 of the rotary handle device 1 illustrating the cruciform-shaped latch 11 and the extender rod 12, in a section view X-X, in an "OFF" position, and where the tooth 11*a* of the cruciform-shaped latch 11 is shown detached from the face 8*f* of the sliding limiting drive member 8, which allows it to move outside the cruciform-shaped coupling cavity 4*h* of the grip 4.

Figure 12:
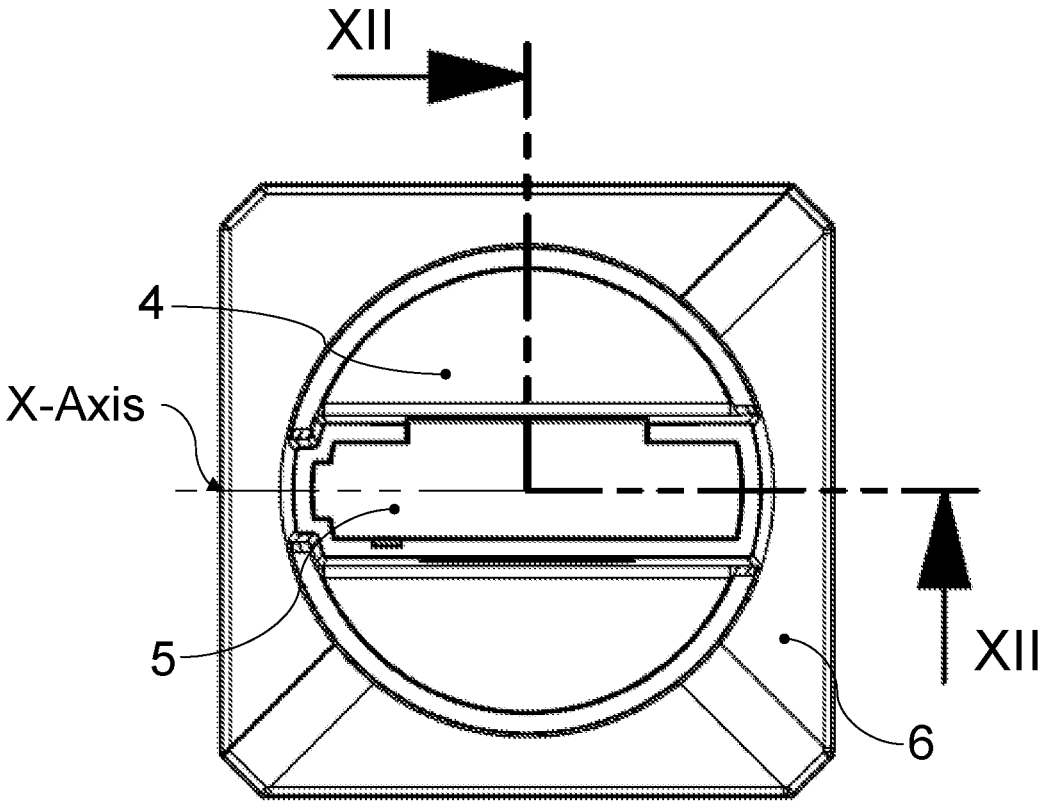
FIG. 12 is an upper front view of the assembly of the rotary handle device, in an "OFF LOCK" position, according to an exemplary embodiment of the present invention.

FIG. 12 shows an upper front view of the assembly 2 of the rotary handle device 1, in an "OFF LOCKED" position, illustrating the sliding button 5, preferably longitudinally aligned to the axis of symmetry "X-Axis", the grip 4 and the attachment base 6.

Figure 13:
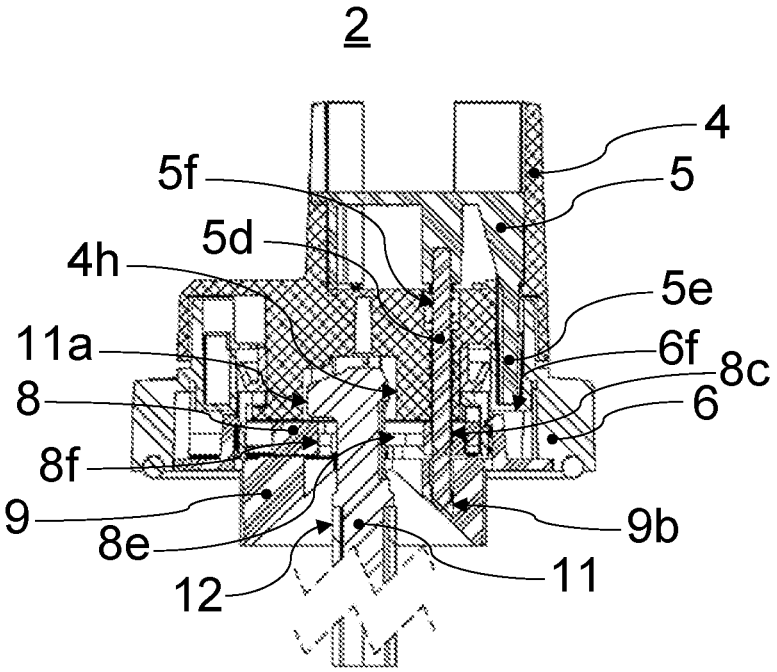
FIG. 13 shows the assembly of the rotary handle device, as well as the cruciform-shaped latch and the extender rod, in a section view XII-XII, in the "OFF LOCK" position, according to an exemplary embodiment of the present invention.

FIG. 13 shows the assembly 2 of the rotary handle device 1 illustrating the tooth 11*a* of the cruciform-shaped latch 11 and the extender rod 12, in a section view XII-XII, in an "OFF LOCKED" position, and in which the tooth 11*a* of the cruciform-shaped latch 11 is featured in attachment to the face 8*f* of the sliding limiting drive member 8, shown in FIGS. 7A and 7B, preventing passage of the grip 4 outside the cruciform-shaped coupling cavity 4*h*, already represented in FIGS. 4 and 11, as well as the advanced position of the trigger pin 5*d* of sliding button 5, which passes through the passing hole 8*c* of the sliding limiting drive member 8. Further, the trigger pin 5*d* is introduced in the blind hole 9*b* of the cover 9 shown in FIG. 8, while it is also possible to see the position locking rod 5*e* introduced in the positioning seat 6*f*

Figure 14:
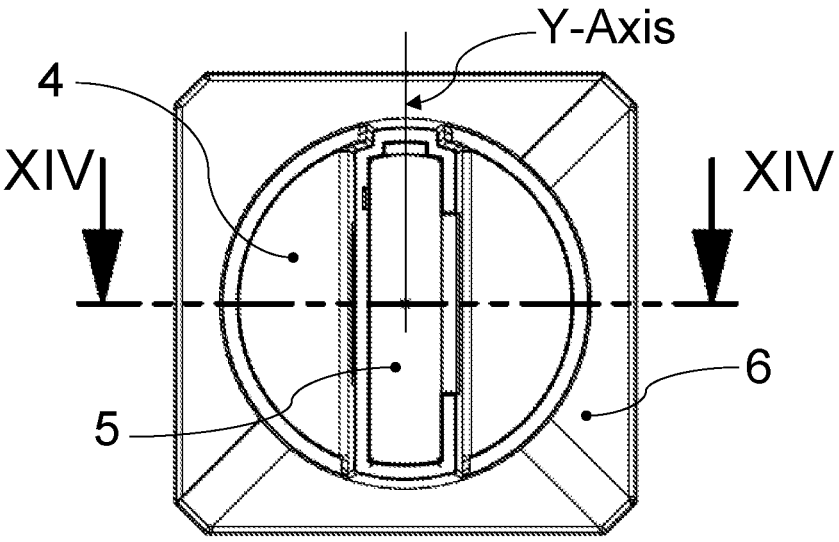
FIG. 14 is an upper front view of the assembly of the rotary handle device, in the "ON" position, according to an exemplary embodiment of the present invention.

FIG. 14 shows an upper front view of the assembly 2 of the rotary handle device 1, in an "ON" position, illustrating the sliding button 5, preferably longitudinally aligned to the axis of symmetry "Y-Axis", the grip 4 and the attachment base 6.

Figure 15:
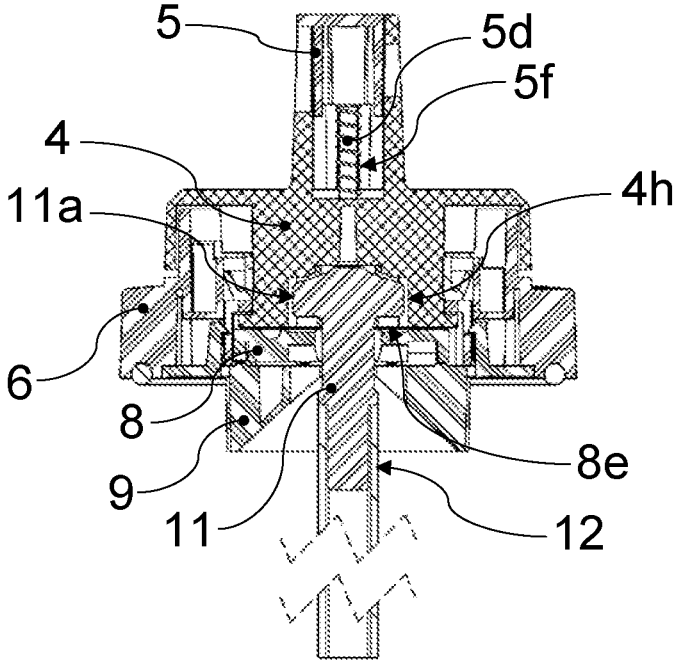
FIG. 15 shows the assembly of the rotary handle device, as well as the cruciform-shaped latch and the extender rod, in a section view XIV-XIV, in the "ON" position, according to an exemplary embodiment of the present invention.

FIG. 15 shows the assembly 2 of the rotary handle device 1, illustrating the sliding button 5, the grip 4, the sliding limiting drive member 8, the trigger pin 5*d*, the motion return spring 5*f*, as well as the cruciform-shaped latch 11 and the extender rod 12, in a section view XIV-XIV, in the "ON" position, where the tooth 11*a* of the cruciform-shaped latch 11 is shown as fixed by the teeth 8*e* of the sliding limiting drive member 8 in a cross sectional view, which prevents it from moving out of the cruciform-shaped coupling cavity 4*h* of the grip 4.

Figure 16:
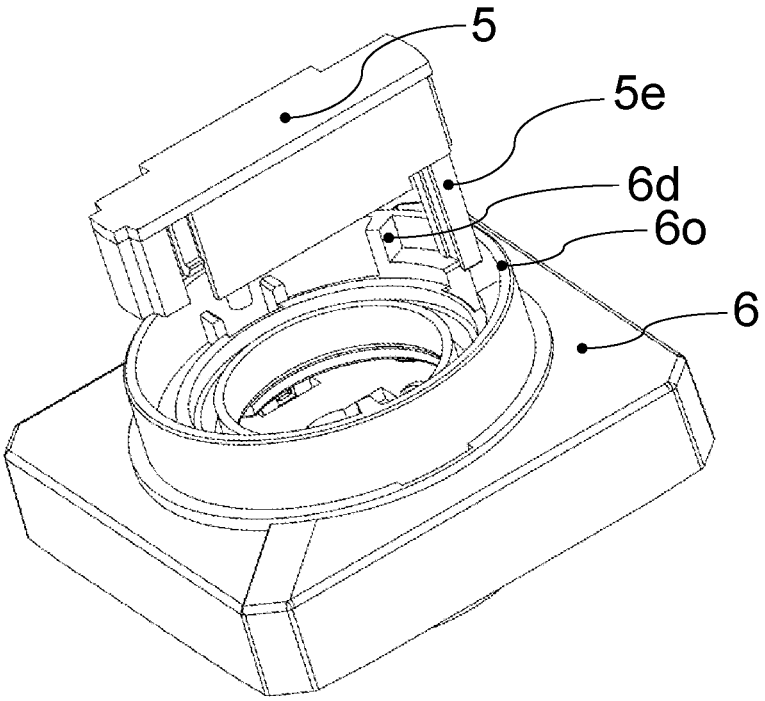
FIG. 16 shows a perspective view of the assembly of the rotary handle device, in the "OFF" position, with the grip hidden, where a lock of the button is visible below an edge of the base and prevented from rotatably overcoming a radial limiting member, according to an exemplary embodiment of the present invention.

FIG. 16 shows the assembly 2 of the rotary handle device 1 in a perspective view, in an "OFF" position, with the grip 4 hidden in order to provide a better view of the internals of the attachment base 6, where the position locking rod 5*e* of the sliding button 5 can be seen below an edge 6*o* of the attachment base 6, prevented from rotatably overcoming the rotary limiting member 6*d* in a counter-clockwise rotation direction, and also prevented from rotatably overcoming the rotary limiting member 6*e* in a clockwise rotation direction, as shown in FIG. 5, according to an exemplary embodiment of the present invention.

Figure 17:
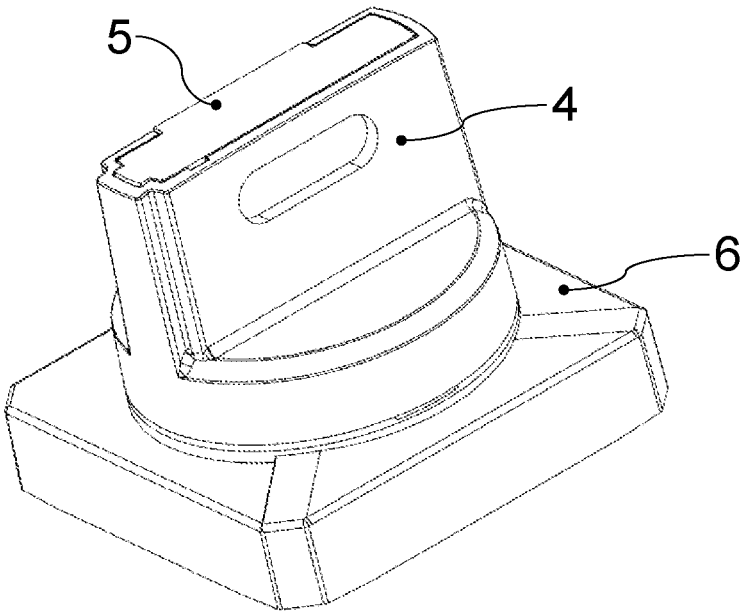
FIG. 17 shows a perspective view of the assembly of the rotary handle device, in the "OFF" position, with the grip apparent.

FIG. 17 shows the assembly 2 of the rotary handle device 1 in a perspective view, in an "OFF" position, in accordance with the FIG. 16, but with the grip 4 not hidden, but featured, in order to provide a better view of the external of the attachment base 6, according to an exemplary embodiment of the present invention.

FIGS. 1 and 9-17 represent mounting exemplary embodiments of an assembly 2 of the rotary handle device 1, among other components.

The rotary handle device 1 is mainly designed to operate a switching device, either for switching or sectioning (not shown), such as a molded case circuit breaker or a motor circuit breaker, through a motion transmission accessory. For example within a hinged door 13 of a cabinet (not shown), the rotary handle device 1 is capable of operating main functions such as "OFF" (better shown in FIGS. 10 and 11), "ON", which is reached from the initial resting position "OFF" by inputting a twisting motion to the grip 4 that rotates clockwise, connected to the attachment base 6, where the grip 4 reaches the "ON" position while the sliding limiting drive member 8 arrests the cruciform-shaped latch 11, preventing opening of the hinged door 13, the "ON" position better observed in FIG. 14 and in section view XIV-XIV of FIG. 15, through the face 8*f* of cruciform-shaped latch 11 and of the additional extender rod 12. In both cases, the rotary handle 1 attaches to an internal transmission mechanism, mounted on a molded case circuit breaker (not shown), such as in disclosed document EP0564173B1, or directly to the drive shaft of a motor circuit breaker (not shown), such as in disclosed document FR2867895A1.

In its initial "OFF" position, the assembly 2 of the rotary handle device 1 features the cruciform-shaped latch 11 as shown in section view X-X of FIG. 11, where it is featured detached from the face 8*f* of the sliding limiting drive member 8, which is seen as recessed from the tooth 11*a*, which allows passage outside the cruciform-shaped coupling cavity 4*h* of the grip 4, so that the rotary handle device 1, attached to the hinged door 13 of an electric cabinet (not shown), allows opening of the hinged door 13 of the electric cabinet (not shown), releasing the cruciform-shaped latch 11 and tooth 11*a* for detachment.

In its optional "OFF LOCKED" position, the assembly 2 of the rotary handle device 1, shown in FIG. 12, is featured in a section view XII-XII shown in FIG. 13, in which the tooth 11*a* of the cruciform-shaped latch 11 is shown as blocked by the face 8*f* of the sliding limiting drive member 8, shown in FIG. 7A, which prevents passage of the cruciform-shaped latch 11 outside the cruciform-shaped coupling cavity 4*h* of the grip 4, and in which the rotary handle device 1, attached to the hinged door 13 of an electric cabinet or case (not shown), prevents opening of the door 13, not releasing the cruciform-shaped latch 11 and tooth 11*a* for detachment.

During the pressure activation movement of the sliding button 5, to enable blocking of the rotary handle device 1 in the "OFF LOCKED" position, the sliding limiting drive member 8, in order to allow passage of the trigger pin 5*d* in an advanced position, with the movement being made easier by the translational guide seat 8*l*, better shown in FIG. 7B, that promotes smooth movement between the inlet position of the trigger pin 5*d* and the end position of sliding limiting drive member 8, as shown in FIG. 9, which enables vertical movement of the sliding button 5 regarding the grip 4, pressing the motion return spring 5*f*, mounted around the trigger pin 5*d* of the sliding button 5 and allowing placement of a padlock (not shown) through the lock element hole 4*d*, shown in FIG. 3B, according to an exemplary embodiment of the present invention.

In its final "ON" position, the assembly 2 of the rotary handle device 1, better shown in FIG. 14, features the cruciform-shaped latch 11 in a section view XIV-XIV shown in FIG. 15, in which it is shown as attached to the teeth 8*e* of the sliding limiting drive member 8, shown in FIG. 7A, which prevent passage outside the cruciform-shaped coupling cavity 4*h* of the grip 4, and in which the rotary handle device 1 attached to the hinged door 13, shown in FIG. 1, of an electric cabinet or electric case (not shown) prevents opening, not releasing the cruciform-shaped latch 11 and tooth 11*a* for detachment. In addition, in the construction of the sliding limiting drive member 8, the positioning seat 8*m* is built with a small recess, so that when an attempt to open the cabinet door occurs, the positioning seat 8*m* can prevent any unintentional sideways sliding from occurring, and the cruciform-shaped latch 11 can be detached from the sliding limiting drive member 8.

Under normal operating conditions, these are the main features advisable for safe operation of an electric protection panel cabinet. Exemplary "TRIPPED" or "RESET" operation states are not herein disclosed, being included in the state of the art and incorporated to the invention previously described in an optional manner, not in a fundamental or prohibitive manner.

Optionally, the rotary handle device 1 allows blocking in an "ON LOCKED" operating position (not shown) through the trigger pin 5*d* of the sliding button 5 on the optional blocking hole 8*d*, in which, through the teeth 8*e* of the sliding limiting drive member 8 (not shown in detail), prevents removal of the cruciform-shaped latch 11, in which the bearing pin 8*g* guides the cross-sectional movement of the sliding limiting drive member 8, comprising the seal notch 8*h*, related to the bearing hole 6*k* of the attachment base 6.

Also optionally, the bearing hole 6*k* of the attachment base 6 can be used in opening the panel door, under exceptional maintenance conditions in an "ON" position and can release the cruciform-shaped latch 11 from the teeth 8*e*. The sliding limiting drive member 8 moves when the bearing pin 8*g* is externally pressed through the bearing hole 6*k* of the attachment base 6 and the protruding rails 8*i*, related to the sliding rails 6*m* of the base guide 6 and the seating base 8*j*, to the return spring 8*k*.

In order to prevent blocking in the "ON" position, the assembly 2 of the rotary handle device 1 can be equipped with the ribbed positioning seat 6*g* at the attachment base 6 that prevents the position locking rod 5*e* of the sliding button 5 from lodging there, therefore preventing the sliding button 5 from advancing against the grip 4, thus not allowing opening of the lock element hole 4*d* for accommodating a lock, and subsequent blocking in this "ON" position.

For the operation modes to be successful when applied by the user, various types of devices were built in the state of the art, and the present invention in particular has culminated in the simplification of components involved in the mounting of the assembly 2 of the rotary handle device 1, regarding a quick and simplified mounting sequence.

The assembly 2, incorporating the aforementioned operation modes, is obtained in a sequential mounting, through pressure fastening engagements snap-fits between its components, comprising the attachment base 6 that on its external surface 3 receives the grip 4 and the sliding button 5, mounted onto the grip 4, having fixing through pressure fastening engagements snap-fits between components, comprising the grip 4, the blind hole 4*o* related to receiving the mounted settling pin 5*c*, and the rotation blocking passing hole 4*b* to receive mounted the trigger pin 5*d* of the position locking rod 5*e* of the sliding button 5, in order to carry out the "LOCK" function, the sliding button 5 is designed to slide longitudinally from the trigger pin 5*d*, with the axial movement of the sliding button 5, limited by the cavity 4*g* of the grip 4, that is related to the limiting bottom 5*h*, and the guide assembly groove 4*e* on the grip 4 related to retaining the pressure fastening engagements snap-fit 5*g* of the sliding button 5, assisted by the motion return spring 5*f*, which keeps the upper front face of the sliding button 5 in a resting position next to the edge of the grip 4, and when under pressure, limited to the contact the limiting bottom 5*h* with the cavity 4*g* of the grip 4, so that when performing the "LOCK" function, the sliding button 5 remains under pressure and limited to the contact with the limiting bottom 5*h* with the cavity 4*g* of the grip 4.

In order to provide smart attachment of the grip 4 onto the attachment base 6 poka-yoke, the attachment base 6, having the central orifice 6*a* and passing recessions 6*b*, 6*c*, in which the dimensions of the passing recession 6*b* are different from the passing recession 6*c*, provided in order to exclusively allow mounting or dismounting of the attachment base 6 in relation to the grip 4 when both flaps 4*j*, 4*k*, where the dimensions of flap 4*j* and flap 4*k* are different, and protruding from the cylindrical ring 4*l* of the grip 4, are coincidentally positioned regarding the passing recessions 6*b*, 6*c*, and simultaneously, the central orifice 6*a*, in order to allow mounting or dismounting between each other, the grip 4 is built so that the passing hole 4*n* is positioned at 90° from the flaps 4*j*, 4*k*.

The counterpart, namely the attachment base 6, does not allow proper positioning for dismounting when the position locking rod 5*e* of the sliding button 5 is included on the mounting between the attachment base 6 and grip 4, below the edge 6*o* of the attachment base 6, shown in FIG. 16, prevented from rotatably overcoming the rotary limiting member 6*d* in a counter-clockwise rotation direction, and prevented from rotatably overcoming the rotary limiting member 6*e* in a clockwise rotation direction, both also shown in FIG. 5, and the position locking rod 5*e* also shown in section view X-X in FIG. 11.

Viewed internally, the sliding limiting drive member 8, shown in FIGS. 1 and 7A, comprising the central hole 8*a* that is introduced in the attachment base 6, where the limiting member 8, in a cross sectional direction from the rotation axis of the rotary handle device 1 while moving, in order to either block or release the tooth 11*a* of the cruciform-shaped latch 11, through the sliding surfaces 8*b* that interact with the fixing cover 9, and where the sliding limiting drive member 8 allows attachment of the trigger pin 5*d* of the sliding button 5 shown in FIG. 2, on the "OFF" operation position shown in FIGS. 10 and 11, in the passing hole 8*c*, shown in FIG. 7A, when the sliding button 5 seen in FIG. 13 is pressed.

Finally, viewed internally, in order to complete the assembly 2 of the rotary handle device 1, the fixing cover 9 comprising the cruciform-shaped hole 9*a* in order to allow passage of the cruciform-shaped latch 11, passing engagement holes 9*c* of engaging the holes 6*n* at the attachment base 6, settling rails 9*d*, for contact with the sliding surfaces 8*b* of the sliding limiting drive member 8, pressure fastening engagements snap-fits 9*e*, for locking at the locking holes 6*i* of the attachment base 6, as well as guide bars 9*f* and the seating base 8*j* of the sliding limiting drive member 8, related to movement of the return spring 8*k*, in order to enable the blocking function of the cruciform-shaped latch 11.

The mounting of the assembly 2 comprises, from the external surface 3 (to a user), the attachment base 6 that receives the grip 4 and the sliding button 5, comprising the pressure fastening engagements snap-fit 5*g*, related to the guide assembly groove 4*e* and the assembly guide groove 4*f* for the pressure fastening engagements snap-fit 5*g*, when mounted to each other, to the grip 4 and sliding button 5, allowing movement on the groove between the grip 4 and the sliding button 5, in which between the external surface 3 and internal portion 7 for fastening between the sliding button 5, the grip 4, the attachment base 6 and the fixing cover 9, the pressure fastening engagements snap-fits 5*g*, 9*e* are used in order to close the assembly 2, where the pressure fastening engagements snap-fit 9*e* is positioned radially to the cruciform-shaped central hole 9*a* of the fixing cover 9, for engagement next to the locking holes 6*i* of the attachment base 6 for closure of the assembly 2, which provides, during use and manufacturing, an easier factory management, eliminating base support devices for possible tightening of screws, electric screw drivers and other accessories, specific mounting areas, that increase mounting operation investment costs, as well as time used in fastening components.

Additionally, the present invention also refers to a method for smart and sequential mounting, also known as "poka-yoke", between the grip 4 and the attachment base 6 of the assembly 2 of the rotary handle device 1, the method comprising:

Introducing the grip 4 in the attachment base 6 through the external surface 3, from the cylindrical ring 4*l* of the grip 4 and the flaps 4*j*, 4*k*, protruding from the grip 4 onto the central orifice 6*a* and the passing recessions 6*b*, 6*c*, of the attachment base 6 in a coincidental position between the flaps 4*j*, 4*k* on the passing recessions 6*b*, 6*c* of the attachment base 6 until the support base 4*i* touches the support ring 6*h*.

Twist the previously introduced grip 4 until the "OFF" position is reached, where the passing hole 4*n* coincides with the positioning seat 6*f*, when mounted between each other.

Introduce the sliding button 5 in the cavity 4*g* of the grip 4, the sliding button 5 comprising the settling pin 5*c*, the trigger pin 5*d* of the position locking rod 5*e* for blocking, and the motion return spring 5*f*, until the pressure fastening engagements snap-fit 5*g* reaches the guide assembly groove 4*e* of the grip 4.

The mounting method prevents removal of the grip 4 from the attachment base 6, unless the sliding button 5 is removed first. This was provided through an exemplary angle of 90° between the flap 4*j* and the passing hole 4*n*, at the grip 4, the passing hole 4*n* coinciding with the passage of the position locking rod 5*e* of the sliding button 5, when mounted to the grip 4, is positioned below the edge 6*o* of the attachment base 6, so that the position locking rod 5*e* of the sliding button 5 is prevented from rotatably overcoming the rotary limiting member 6*d*, in which an exemplary angle $\alpha$ is less than 90°, defined between the rotary limiting member 6*d* and the passing recession 6*b* of the attachment base 6, thus preventing the flap 4*j* of the grip 4 from engaging the passing recession 6*b* upon dismounting, considering that when the sliding button 5 is at the cavity 4*g* of the grip 4, preventing the flaps 4*j*, 4*k* from freely rotary at any angle, through the rotary limiting members 6*d*, 6*e*. In addition, the flap 4*j* and the flap 4*k* have different dimensions from one another, while the mounting or dismounting between grip 4 and attachment base 6 may only take place upon the coincidence between the pairs of flaps 4*j*,4*k* and passing recessions 6*b*, 6*c*. This prevents mistakes in mounting on the method, providing smart and sequential mounting process, also known as "poka-yoke", according to an exemplary embodiment of the present invention.

Optionally, the assembly 2 of the rotary handle device 1 can be sealed against weathering, such as water, dust, and similar conditions, through sealants, seal ring 6*b* and elements 5*a*, 6*c*, 8*c*.

Also optionally, the assembly 2 of the rotary handle device 1 can be added by the complementary steering guide 10 of the cruciform-shaped latch 11.

It should be evident that other modifications and variations applied to this invention are considered within the scope of the present invention.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A rotary handle device comprising:

a sliding button;

a grip having:

a first end into which at least a portion of the sliding button is received; and a second end;

an attachment base having:

a first end into which the second end of the grip is received; and a second end;

wherein the grip is releasably mounted to the attachment base; and wherein the grip is rotatable while mounted to the attachment base;

a sliding limiting drive member located within the attachment base;

a fixing cover mounted in proximity to the second end of the attachment base;

a complementary steering guide;

a cruciform-shaped latch; and pressure fastening engagements snap-fits;

wherein the grip, sliding button, attachment base and fixing cover are engagingly communicative to one another to form the rotary handle device via the pressure fastening engagements snap-fits.

2. The rotary handle device of claim 1, wherein the grip, sliding button, attachment base and fixing cover are engagingly communicative to one another to form the rotary handle device only via the pressure fastening engagements snap-fits.

3. The rotary handle device of claim 1, wherein the grip comprises a guide assembly groove;

wherein the sliding button comprises one of the pressure fastening engagements snap-fits; and wherein the guide assembly groove is for movement guiding of the pressure fastening engagements snap-fit of the sliding button.

4. The rotary handle device of claim 1, wherein the grip comprises a first flap radially spaced apart from a second flap, each in proximity to the second end of the grip;

wherein the attachment base comprises a first passing recession radially spaced apart from a second passing recession, each in proximity to the second end of the attachment base;

wherein the first flap and the first passing recession are sized such that the first flap can move through the first passing recession when cooperative aligned;

wherein the second flap and the second passing recession are sized such that the second flap can move through the second passing recession when cooperative aligned; and wherein only during cooperative alignment of the respective flaps of the grip to the corresponding respective passing recessions of the attachment base can the grip be mounted to, and released from, the attachment base.

5. The rotary handle device of claim 4, wherein the first flap and the second flap are different in respect to at least one of size and shape such that at least one of:

the first flap can move through the first passing recession when cooperative aligned with the first passing recession, and cannot move through the second passing recession when otherwise cooperative aligned with the second passing recession; and the second flap can move through the second passing recession when cooperative aligned with the second passing recession, and cannot move through the first passing recession when otherwise cooperative aligned with the first passing recession.

6. The rotary handle device of claim 4, wherein the first flap and the second flap are of such similarity in respect to size and shape that first flap can move through either the first or second passing recession when cooperative aligned with one of them, and the second flap can move through the other of the first or second passing recession when cooperative aligned with the other one of them.

7. The rotary handle device of claim 4, wherein the grip further comprises:

a cruciform-shaped coupling cavity;

a cylindrical ring; and first and second passing holes;

wherein the first and second flaps protrude from the cylindrical ring; and wherein the angle between the first flap and the first passing hole is 90°.

8. The rotary handle device of claim 4, wherein the attachment base has a horizontal axis of symmetry and a vertical axis of symmetry and further comprises:

a central orifice;

first and second radially spaced apart rotary limiting members;

a first positioning seat;

a ribbed positioning seat; and a support ring;

wherein the first positioning seat is aligned to the horizontal axis of symmetry;

wherein the angle between the first rotary limiting member and the first passing recession is less than 90°; and wherein the angle between the second rotary limiting member and the second passing recession is less than 90°.

9. The rotary handle device of claim 1, wherein the device has at least an "OFF" operating position and an "ON" operating position, the "OFF" and "ON" operating positions reached via rotational movement of the grip;

wherein the sliding button comprises a trigger pin;

wherein the sliding limiting drive member has a passing hole and a blocking hole;

wherein in the "OFF" operating position, the sliding limiting drive member allows coupling of the trigger pin of the sliding button at the passing hole; and wherein in the "ON" operating position, the sliding limiting drive member allows locking of the trigger pin of the sliding button at the blocking hole.

10. A rotary handle device comprising:

a sliding button;

a grip having:

a first end into which at least a portion of the sliding button is received;

a second end;

a first flap; and a second flap;

wherein the first flap is radially spaced apart from the second flap and each are in proximity to the second end of the grip;

an attachment base having:
a first end;
a second end;
a first passing recession; and
a second passing recession;
wherein the first passing recession is radially spaced apart from the second passing recession and each are in proximity to the second end of the attachment base;
wherein the grip is releasably mounted to the attachment base; and
wherein the grip is rotatable while mounted to the attachment base;
a sliding limiting drive member located within the attachment base;
a fixing cover mounted in proximity to the second end of the attachment base; and
pressure fastening engagements snap-fits;
wherein the grip, sliding button, attachment base and fixing cover are engagingly communicative to one another to form the rotary handle device via only the pressure fastening engagements snap-fits;
wherein the first flap and the first passing recession are sized such that the first flap can move through the first passing recession when cooperative aligned;
wherein the second flap and the second passing recession are sized such that the second flap can move through the second passing recession when cooperative aligned; and
wherein only during cooperative alignment of the respective flaps of the grip to the corresponding respective passing recessions of the attachment base can the grip be mounted to, and released from, the attachment base.

11. The rotary handle device of claim 10, wherein the device has at least an "OFF" operating position and an "ON" operating position, the "OFF" and "ON" operating positions reached via rotational movement of the grip;
wherein the sliding button comprises a trigger pin;
wherein the sliding limiting drive member has a passing hole and a blocking hole;
wherein in the "OFF" operating position, the sliding limiting drive member allows coupling of the trigger pin of the sliding button at the passing hole; and
wherein in the "ON" operating position, the sliding limiting drive member allows locking of the trigger pin of the sliding button at the blocking hole.

12. The rotary handle device of claim 10 further comprising:
a complementary steering guide; and
a cruciform-shaped latch.

13. The rotary handle device of claim 10, wherein the first flap and the second flap are different in respect to at least one of size and shape such that at least one of:
the first flap can move through the first passing recession when cooperative aligned with the first passing recession, and cannot move through the second passing recession when otherwise cooperative aligned with the second passing recession; and
the second flap can move through the second passing recession when cooperative aligned with the second passing recession, and cannot move through the first passing recession when otherwise cooperative aligned with the first passing recession.

14. The rotary handle device of claim 10, wherein the first flap and the second flap are of such similarity in respect to size and shape that first flap can move through either the first or second passing recession when cooperative aligned with one of them, and the second flap can move through the other of the first or second passing recession when cooperative aligned with the other one of them.

15. The rotary handle device of claim 10, wherein the grip further comprises:
a cruciform-shaped coupling cavity;
a cylindrical ring; and
first and second passing holes;
wherein the first and second flaps protrude from the cylindrical ring; and
wherein the angle between the first flap and the first passing hole is 90°.

16. The rotary handle device of claim 10, wherein the attachment base has a horizontal axis of symmetry and a vertical axis of symmetry and further comprises:
a central orifice;
first and second radially spaced apart rotary limiting members;
a first positioning seat;
a ribbed positioning seat; and
a support ring;
wherein the first positioning seat is aligned to the horizontal axis of symmetry;
wherein the angle between the first rotary limiting member and the first passing recession is less than 90°; and
wherein the angle between the second rotary limiting member and the second passing recession is less than 90°.

17. The rotary handle device of claim 10, wherein the grip further comprises a guide assembly groove;
wherein the sliding button comprises one of the pressure fastening engagements snap-fits; and
wherein the guide assembly groove is for movement guiding of the pressure fastening engagements snap-fit of the sliding button.

18. A rotary handle device comprising:
a sliding button comprising a trigger pin;
a grip having:
a first end into which at least a portion of the sliding button is received; and
a second end;
an attachment base having:
a first end into which the second end of the grip is received; and
a second end;
wherein the grip is releasably mounted to the attachment base; and
wherein the grip is rotatable while mounted to the attachment base;
a sliding limiting drive member located within the attachment base and having:
a passing hole; and
a blocking hole; and
pressure fastening engagements snap-fits;
wherein the grip, sliding button, and attachment base are engagingly communicative to one another to form the rotary handle device via the pressure fastening engagements snap-fits;
wherein the device has at least an "OFF" operating position and an "ON" operating position, the "OFF" and "ON" operating positions reached via rotation of the grip;
wherein in the "OFF" operating position, the sliding limiting drive member allows coupling of the trigger pin of the sliding button at the passing hole; and wherein in the "ON" operating position, the sliding limiting drive member allows locking of the trigger pin of the sliding button at the blocking hole.

19. The rotary handle device of claim 18, wherein the grip comprises a guide assembly groove;

wherein the sliding button comprises one of the pressure fastening engagements snap-fits; and wherein the guide assembly groove is for movement guiding of the pressure fastening engagements snap-fit of the sliding button.

20. A rotary handle device comprising:

a sliding button;

a grip comprising a guide assembly groove, a cruciform-shaped coupling cavity, a cylindrical ring, a first flap radially spaced apart from a second flap, and first and second passing holes, wherein the first and second flaps protrude from the cylindrical ring;

an attachment base comprising a ribbed positioning seat, a support ring, and first and second passing recessions; and pressure fastening engagements snap-fits;

wherein the sliding button comprises one of the pressure fastening engagements snap-fits;

wherein the device has at least an "OFF" operating position and an "ON" operating position, the "OFF" and "ON" operating positions reached via rotational movement of the grip; and wherein the rotary handle device is formed by a process comprising:

introducing the grip into the attachment base from the cylindrical ring of the grip and the first and second flaps, at the first and second passing recessions of the attachment base until a support base of the grip touches the support ring of the attachment base;

twisting the introduced grip until the "OFF" operating position, wherein one of the first and second passing holes of the grip coincide with the ribbed positioning seat of the attachment base when mounted between one another; and introducing the sliding button into the cruciform-shaped coupling cavity of the grip until the pressure fastening engagements snap-fit of the sliding button reaches the guide assembly groove of the grip.

21. The rotary handle device of claim 18 further comprising:

a complementary steering guide; and a cruciform-shaped latch.

22. The rotary handle device of claim 21, wherein the grip, sliding button, and attachment base are engagingly communicative to one another to form the rotary handle device only via the pressure fastening engagements snap-fits.

* * * * *